US009744435B2

(12) United States Patent
Choi

(10) Patent No.: US 9,744,435 B2
(45) **Date of Patent: *Aug. 29, 2017**

(54) TRANSFORMER TOY CAR AND PLAYING DEVICE USING SAME

(71) Applicant: Shin-Kyu Choi, Seoul (KR)

(72) Inventor: Shin-Kyu Choi, Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/146,095

(22) Filed: May 4, 2016

(65) Prior Publication Data

US 2016/0243429 A1 Aug. 25, 2016

Related U.S. Application Data

(63) Continuation of application No. 14/377,142, filed as application No. PCT/KR2013/001318 on Feb. 20, 2013, now Pat. No. 9,370,725.

(30) Foreign Application Priority Data

Feb. 24, 2012 (KR) ..... 10-2012-0019210
Mar. 26, 2012 (KR) ..... 10-2012-0030798

(51) Int. Cl.
*A63H 17/26* (2006.01)
*A63F 1/04* (2006.01)
(Continued)

(52) U.S. Cl.
CPC ..... *A63F 1/04* (2013.01); *A63F 1/06* (2013.01); *A63H 17/02* (2013.01); *A63H 17/26* (2013.01); *A63H 33/003* (2013.01)

(58) Field of Classification Search
USPC ..... 446/429, 431, 435, 436, 437, 465, 470
See application file for complete search history.

(56) References Cited

U.S. PATENT DOCUMENTS 3,892,086 A 7/1975 Gay et al.
3,953,027 A 4/1976 Katzman et al.
(Continued)

FOREIGN PATENT DOCUMENTS

JP 7-136347 A 5/1995
JP 8-5758 Y2 2/1996
(Continued)

OTHER PUBLICATIONS

International Search Report mailed on Aug. 29, 2013 in counterpart PCT Application No. PCT/KR2013/001318 (6 Pages in Korean with English translation).

*Primary Examiner* — Kurt Fernstrom
(74) *Attorney, Agent, or Firm* — NSIP Law

(57) ABSTRACT

The present invention relates to a transformer toy car that automatically transforms the shape to turn a card over to provide the information on the card, if the card is attached to the transformer toy car. The transformer toy car includes: a separable toy car body; and cards adapted to be attached to the underside of the toy car body, wherein if one of the cards is attached to the underside of the toy car body, a portion of the separable toy car body is separated, and a portion of the separated toy car body pressurizes a floor surface, thereby making the toy car body stand up or turn over and thus allowing the underside surface of the card attached to the underside of the toy car body to be exposed to the outside.

6 Claims, 8 Drawing Sheets

(51) Int. Cl.

| | |
|---|---|
| ***A63H 33/00*** | (2006.01) |
| ***A63F 1/06*** | (2006.01) |
| ***A63H 17/02*** | (2006.01) |

(56) References Cited

U.S. PATENT DOCUMENTS

| | | | | |
|---|---|---|---|---|
| 4,363,186 | A | 12/1982 | Goldfarb et al. | |
| 4,363,187 | A | 12/1982 | Shinohara | |
| 4,526,554 | A | 7/1985 | Goldfarb et al. | |
| 4,591,346 | A | 5/1986 | Ikeda | |
| 4,705,487 | A | 11/1987 | Ishimoto | |
| 4,946,417 | A | 8/1990 | Ishikawa et al. | |
| 5,316,514 | A | 5/1994 | Ellman et al. | |
| 5,667,420 | A | 9/1997 | Menow et al. | |
| 5,727,985 | A | 3/1998 | George et al. | |
| 5,759,083 | A | 6/1998 | Polumbaum et al. | |
| 6,881,122 | B2 | 4/2005 | Bloch et al. | |
| 7,131,887 | B2 | 11/2006 | Hornsby et al. | |
| 7,654,879 | B2 * | 2/2010 | Dunham | A63H 17/004 446/466 |
| 8,348,715 | B2 * | 1/2013 | Miyake | A63H 17/02 446/321 |
| 8,900,031 | B2 * | 12/2014 | Benedict | A63H 17/004 446/437 |
| 2008/0166947 | A1 * | 7/2008 | Bernstein | A63H 17/008 446/464 |
| 2009/0149113 | A1 * | 6/2009 | Lund | A63H 17/004 446/454 |

FOREIGN PATENT DOCUMENTS

| | | | |
|---|---|---|---|
| KR | 1998-016285 | U | 6/1998 |
| KR | 1999-0065295 | A | 8/1999 |

* cited by examiner

TRANSFORMER TOY CAR AND PLAYING DEVICE USING SAME

CROSS-REFERENCE TO RELATED APPLICATIONS

This application is a Continuation of U.S. application Ser. No. 14/377,142, filed on Aug. 6, 2014, which is a National Stage of International Application No. PCT/KR2013/001318, filed Feb. 20, 2013 and published as WO 2013/125836 A2 on Aug. 29, 2013, which claims the benefit under 35 U.S.C. §119(a) Korean Patent Application No. 10-2012-0019210, filed on Feb. 24, 2012, and Korean Patent Application No. 10-2012-0030798, filed on Mar. 26, 2012 the entire disclosures of which are incorporated herein by reference for all purposes.

BACKGROUND

Field of the Invention

The present invention relates to a toy car and a playing device using the same, and more particularly, to a transformer toy car and a playing device using the same that are capable of providing power with which the transformer toy car is driven and automatically transforming the shape to turn a card over to show a user the information printed on the card, if the card is attached to the transformer toy car in the process where the transformer toy car is driven.

Description of the Related Art

A transformer toy has body parts totally taking a shape of a robot or car, and through the assembly of the body parts, it can be transformed to the robot or car. As the transformer toy is transformed to various shapes through the transforming, lots of fun is provided to children who enjoy a variety of plays through the direct assembling thereof.

In case of generally known card plays for children, on the other hand, drawings or characters for the plays are printed on the top or underside surfaces of the square-shaped cards, and the cards turn over to check the information printed on the cards in accordance with given game rules.

Such card plays for children are carried out by placing the cards on a floor by users and turning them over to check the information printed on the cards, so that the playing way is very simple to make the users, especially children feel bored easily and to provide just a function of collecting the drawings or characters printed on the cards.

SUMMARY OF THE INVENTION

Accordingly, the present invention has been made in view of the above-mentioned problems occurring in the prior art, and it is an object of the present invention to provide a transformer toy car and a playing device using the same that provides the power with which the transformer toy car is driven and automatically transforms the shape to turn a card over to show a user the information printed on the card, if the card is attached to the transformer toy car in the process where the transformer toy car is driven.

To accomplish the above object, according to a first aspect of the present invention, there is provided a transformer toy car including: a separable toy car body; and cards adapted to be attached to the underside of the toy car body, wherein if one of the cards is attached to the underside of the toy car body, a portion of the separable toy car body is separated, and a portion of the separated toy car body pressurizes a floor surface, thereby making the toy car body stand up or turn over and thus allowing the underside surface of the card attached to the underside of the toy car body to be exposed to the outside.

According to the present invention, desirably, the toy car body includes: an upper housing; and a lower housing mounted on the lower portion of the upper housing and having a lower body part, a support plate, a support plate torsion spring, an operating bar, an adhesion part and an operating bar torsion spring, whereby if the card is attached to the toy car body, a locking releasing operation is performed by means of the operating bar to allow the support plate rotatably coupled to the underside of the lower body part to be separated from the lower body part and thus to pressurize a floor surface, thereby making the toy car body while driving or stopping stand up or turn over.

According to the present invention, desirably, the upper housing has first and second bonnet parts rotatably coupled to the front side thereof, and if the locking releasing operation is performed by means of the operating bar of the lower housing, the first and second bonnet parts are separatedly open.

According to the present invention, desirably, the upper housing includes: an upper body part taking a shape of a car; the first bonnet part rotatably coupled to one side of the front surface of the upper body part; the second bonnet part rotatably coupled to the other side of the front surface of the upper body part; wheel parts coupled to the upper body part, through which the toy car body is driven; and first and second bonnet torsion springs adapted to apply a given elastic force to the first and second bonnet parts, so that if the locking releasing operation is performed by means of the operating bar of the lower housing, the first and second bonnet parts are rotated around the upper body part and separated from each other.

According to the present invention, desirably, the upper body part includes: upper body hinges by which the first and second bonnet parts are rotatably coupled to each other by means of first and second bonnet rotary shafts; and locking portion through-holes penetrating on the front side thereof, through which first and second bonnet latches for releasing the locking of the first and second bonnet parts are passed.

According to the present invention, desirably, the lower housing includes: a lower body part having a support plate accommodating recess formed on one side thereof; a support plate mounted rotatably on one side thereof with respect to the lower body part by means of a support plate rotary shaft; a support plate torsion spring mounted between the lower body part and the support plate to rotate the support plate by means of the application of a given elastic force therefrom; the operating bar coupled rotatably to the lower body part and operated to release the locking states of the support plate and a portion of the upper housing from their locking state if the card becomes brought into close contact therewith; an adhesion part mounted on the front end of the operating bar in such a manner as to be brought into close contact with the card; and an operating bar torsion spring mounted between the operating bar and the lower body part to apply a given elastic force to the operating bar to maintain the locking state of the operating bar.

According to the present invention, desirably, the lower body part includes: a lower body hinge adapted to supportingly rotate the support plate around the support plate rotary shaft; an operating bar hinge adapted to supportingly rotate the operating bar around an operating bar rotary shaft; a lower body through-hole formed on the lower body part, through which the adhesion part is passed and attached to the card; and an upper torsion spring insertion recess adapted to supportedly insert one side of the support plate torsion spring thereinto.

According to the present invention, desirably, the support plate includes: a support plate hinge coupled to the lower body part by means of the support plate hinge shaft; a lower torsion spring insertion groove adapted to supportedly insert a portion of the support plate torsion spring thereinto; and a support plate locking groove adapted to insert a portion of the operating bar thereinto in such a manner as to maintain the locking state of the support plate.

According to the present invention, desirably, the operating bar includes: an operating bar body having one side formed slantly; an adhesion part accommodating groove formed on one side of the operating bar body to mount the adhesion part thereinto; a support plate latch mounted on the other side of the operating bar body in such a manner as to maintain the locking state of the support plate; and first and second bonnet latches mounted on the top portion of the adhesion part accommodating groove in such a manner as to maintain the locking state of a portion of the upper housing.

According to the present invention, desirably, the operating bar further includes an operating bar lever extended downward by a given length from the other side of the operating bar body and adapted to operate the operating bar in such a manner as to allow the card and the adhesion part to be brought into contact with each other if contacted with the card or the top surface of the card.

According to the present invention, desirably, the adhesion part is formed of any one of a magnet, an absorption plate, and an adhesive having viscosity.

According to the present invention, desirably, each card has a magnetic material or metal plate embedded thereinto.

To accomplish the above object, according to a second aspect of the present invention, there is provided a playing device using a transformer toy car, including: a separable toy car body; cards adapted to be attached to the underside of the toy car body; and a launch pad adapted to pressurize the toy car body to drive the toy car body in an arbitrary direction, wherein if one of the cards is attached to the underside of the toy car body, a portion of the separable toy car body is separated, and a portion of the separated toy car body pressurizes a floor surface, thereby making the toy car body stand up or turn over and thus allowing the underside surface of the card attached to the underside of the toy car body to be exposed to the outside.

According to the present invention, desirably, the launch pad includes: a launch pad body having a hollow interior; a rail extended by a given length from one side of the launch pad body to guide a passage through which the toy car body is driven in an arbitrary direction; a button mounted on the top portion of the launch pad body in such a manner as to release the locking state of a pressurizing part compressed; the pressurizing part mounted at the interior of the launch pad body in such a manner as to be moved horizontally and adapted to pressurize the toy car body; and a coil spring mounted at the interior of the launch pad body to apply the elastic force for pressurizing the toy car body to the pressurizing part.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Hereinafter, an explanation on a transformer toy car according to the present invention will be in detail given with reference to the attached drawing.

Figure 1:
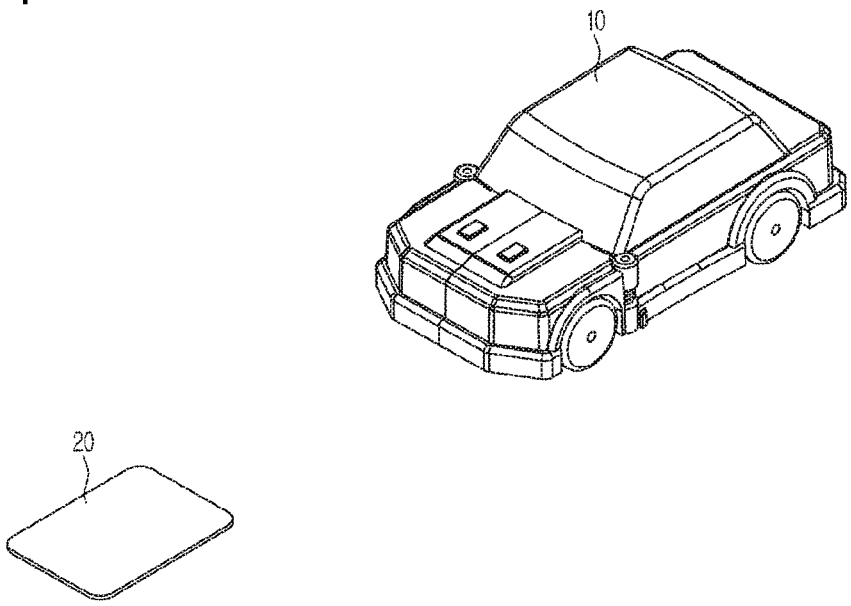
FIG. 1 is a perspective view showing a transformer toy car according to the present invention.
Figure 2:
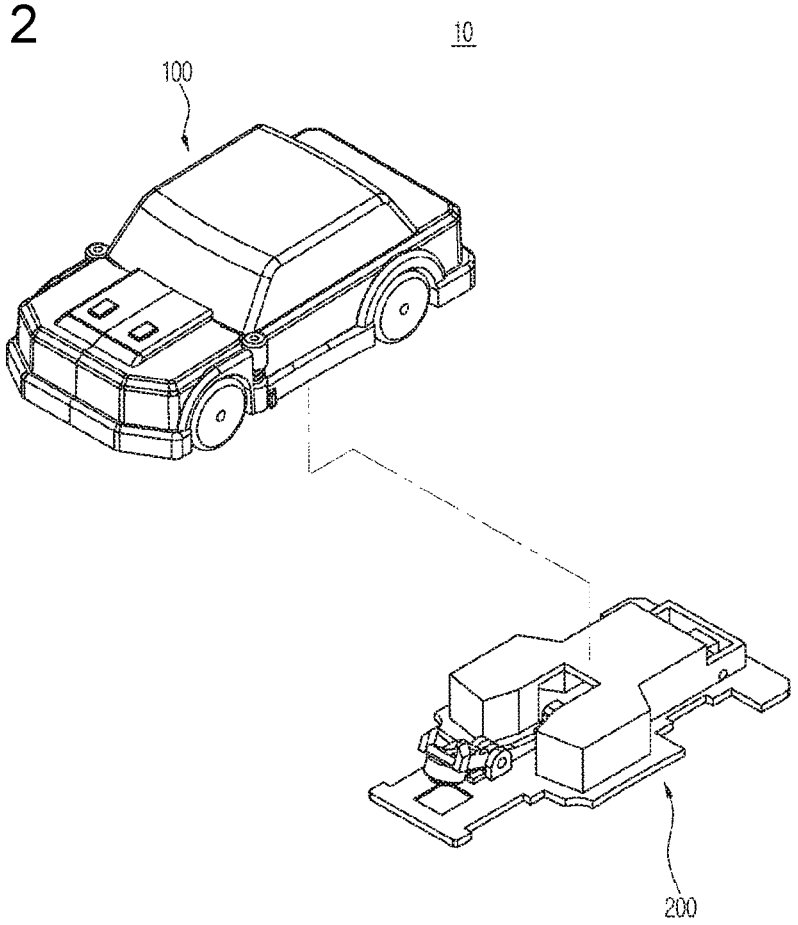
FIG. 2 is a partially exploded perspective view showing the configuration of the transformer toy car according to the present invention.
Figure 3:
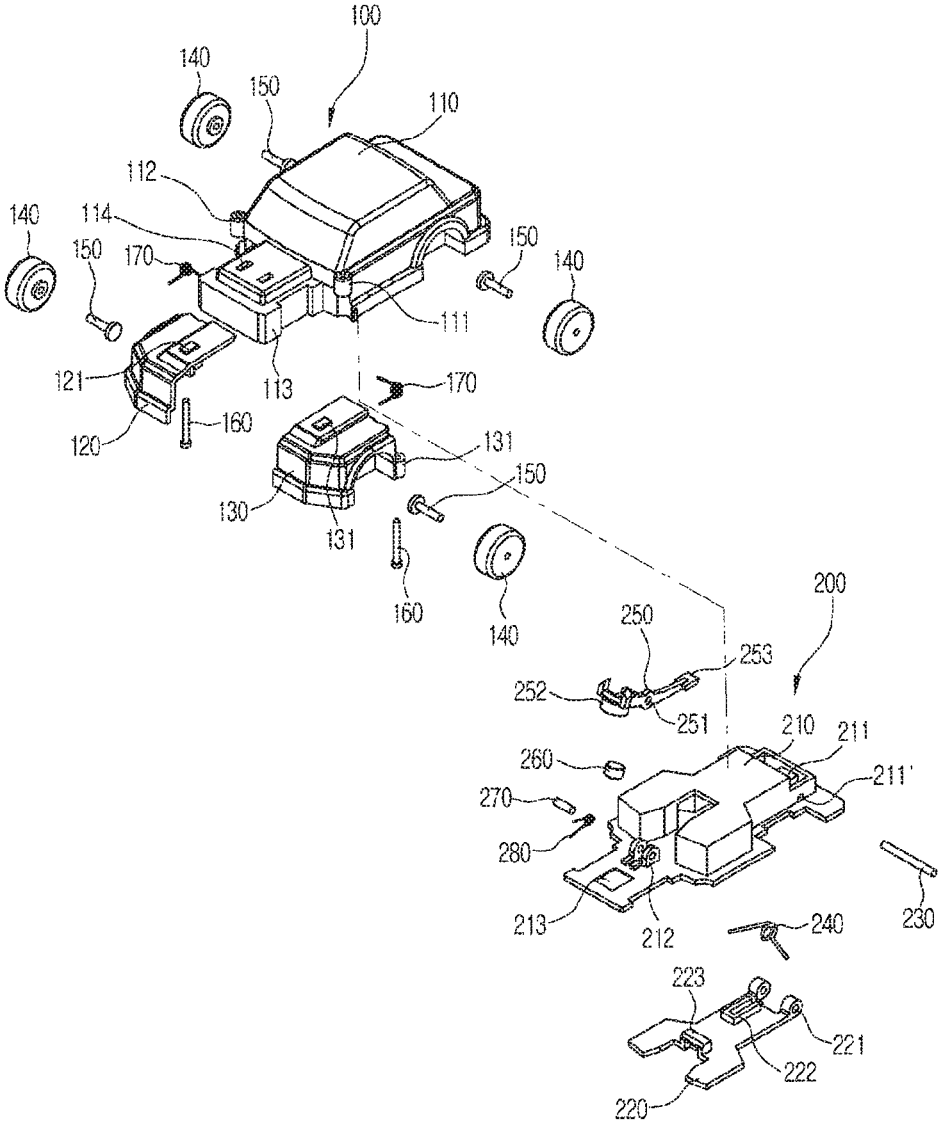
FIG. 3 is an exploded perspective view showing the transformer toy car according to the present invention.
Figure 4:
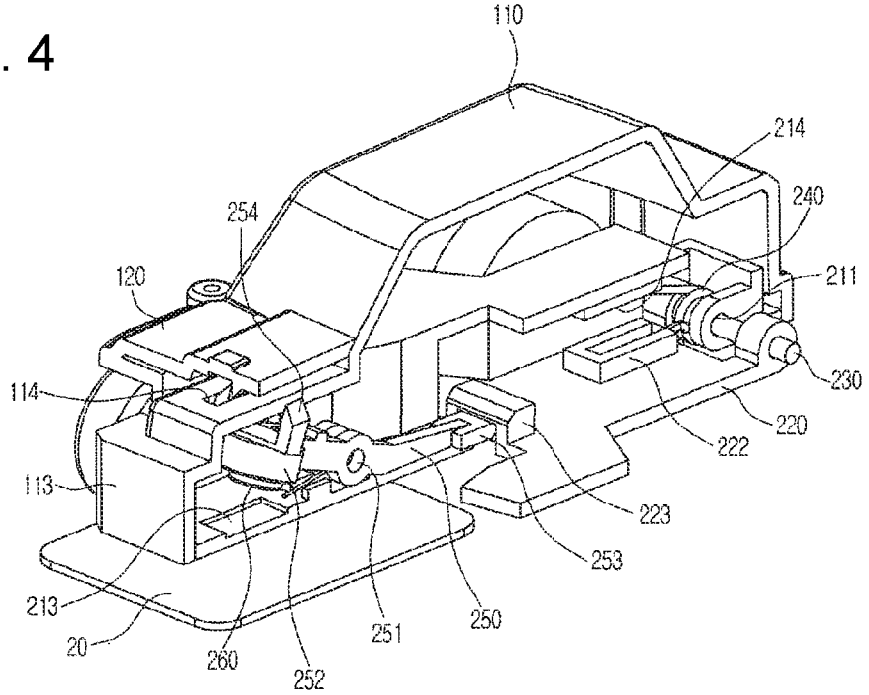
FIG. 4 is a sectional view showing the transformer toy car according to the present invention.
Figure 5:
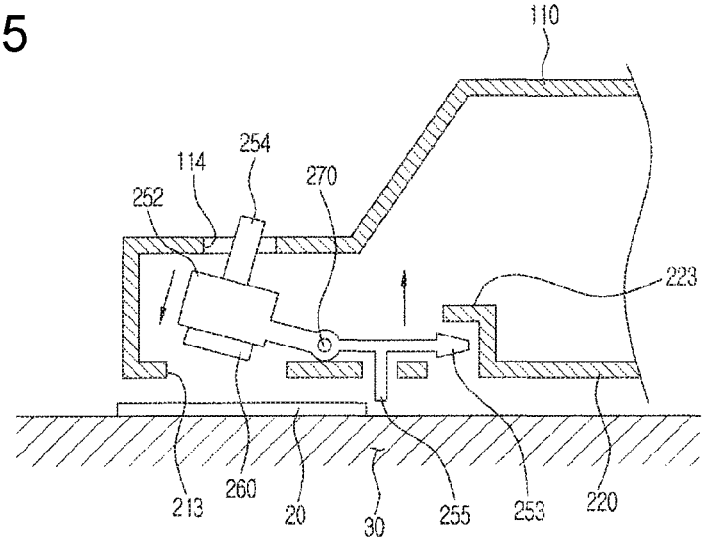
FIG. 5 is a sectional view showing a structure of an operating bar of the transformer toy car according to the present invention.
Figure 6:
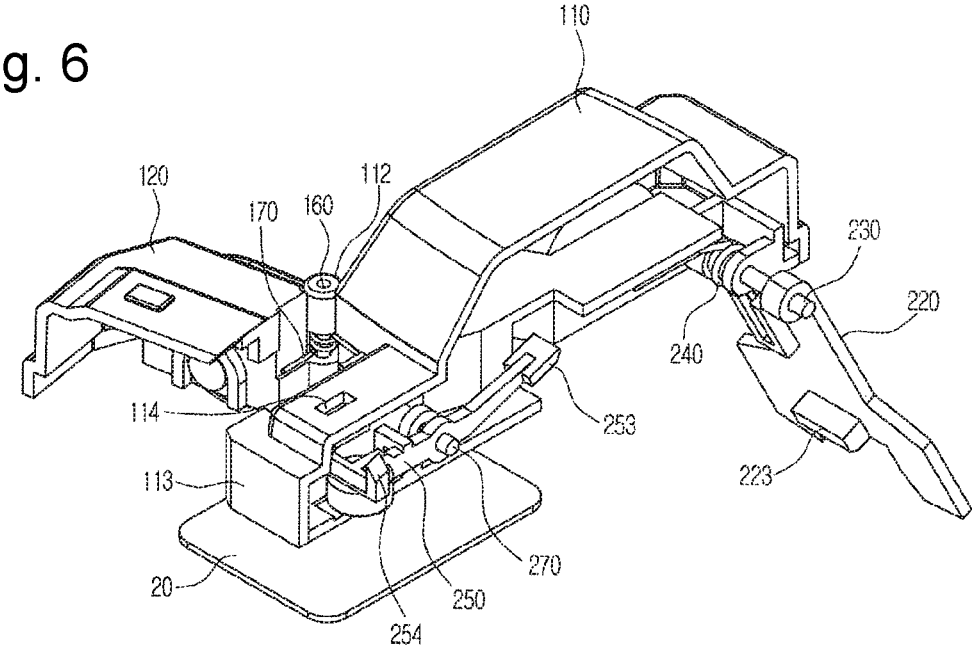
FIG. 6 is a sectional view showing the operating state of the transformer toy car according to the present invention.
Figure 7:
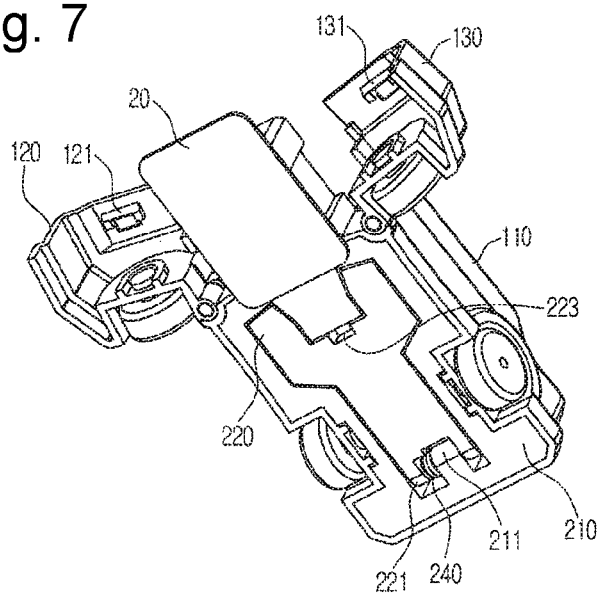
FIG. 7 is a bottom perspective view showing the operating state of the transformer toy car according to the present invention.

FIG. 1 is a perspective view showing a transformer toy car according to the present invention, FIG. 2 is a partially exploded perspective view showing the configuration of the transformer toy car according to the present invention, FIG. 3 is an exploded perspective view showing the transformer toy car according to the present invention, FIG. 4 is a sectional view showing the transformer toy car according to the present invention, FIG. 5 is a sectional view showing a structure of an operating bar of the transformer toy car according to the present invention, FIG. 6 is a sectional view showing the operating state of the transformer toy car according to the present invention, and FIG. 7 is a bottom perspective view showing the operating state of the transformer toy car according to the present invention.

As shown in FIGS.1 to 7, a transformer toy car according to the present invention is largely composed of a toy car body 10 and cards 20 in such a manner where if one card 20 is attached to the underside of the toy car body 10, a portion of the separable toy car body 10 is separated to allow the toy car body 10 to stand up or turn over, thereby causing the underside surface of the card 20 attached to the toy car body 10 to be exposed to the outside. The toy car body 10 largely includes an upper housing 100 and a lower housing 200.

Each card 20, which is formed of a generally square-shaped member, has a coating layer formed on the surface where a given character or game information is printed and a magnetic material or metal plate member embedded thereinto.

The upper housing 100 largely includes an upper body part 110, a first bonnet part 120, a second bonnet part 130, wheel parts 140 and bonnet torsion springs 170, and in this case, if the first bonnet part 120 and the second bonnet part 130 are released from their locking state through locking releasing means of the lower housing 200, they are open generally to a shape of about "V".

The upper body part 110 takes a shape of a car and has upper body hinges 111 and 112 by which the first bonnet part 120 and the second bonnet part 130 are rotatably coupled to each other by means of first and second bonnet rotary shafts 160, an inner body 113 exposed to the outside when the first bonnet part 120 and the second bonnet part 130 are released from the locking state and open to both side of the toy car, and locking portion through-holes 114 penetrating on the inner body 113, through which first and second bonnet latches 254 of an operating bar 250 are passed to allow the first bonnet part 120 and the second bonnet part 130 to be locked or released from their locking state.

The first bonnet part 120 is rotatably coupled to the upper body hinge 112 formed on one side of the front surface of the upper body part 110 by means of the first bonnet rotary shaft 160 and a first bonnet torsion spring 170 and has a first bonnet locking portion 121 engaged with the first bonnet latch 254 of the operating bar 250.

The first bonnet locking portion 121 is formed on the underside of the first bonnet part 120 and engaged with the first bonnet latch 254 to allow the first bonnet part 120 to be fixedly maintained in the locking state, and for example, if the first bonnet latch 254 is moved downward with respect to the upper body part 110, the first bonnet part 120 is rotated around the first bonnet rotary shaft 160 by means of the elastic force of the first bonnet torsion spring 170 and open to the outside of the upper body part 110.

The second bonnet part 130 is rotatably coupled to the upper body hinge 111 formed on the other side of the front surface of the upper body part 110 by means of the second bonnet rotary shaft 160 and a second bonnet torsion spring 170, and the second bonnet part 130 has a second bonnet locking portion 131 engaged with the second bonnet latch 254 of the operating bar 250.

The second bonnet locking portion 131 is formed on the underside of the second bonnet part 130 and engaged with the second bonnet latch 254 to allow the second bonnet part 130 to be fixedly maintained in the locking state, and for example, if the second bonnet latch 254 is moved downward with respect to the upper body part 110, the second bonnet part 130 is rotated to the opposite direction to the first bonnet part 120 around the second bonnet rotary shaft 160 by means of the elastic force of the second bonnet torsion spring 170 and open to the outside of the upper body part 110.

The first bonnet part 120 and the second bonnet part 130 are maintained to a single structure by means of the locking state through the first and second bonnet latches 254 of the operating bar 250 and separated into two parts if the locking state is released.

The wheel parts 140 are coupled to the upper body part 110 by means of wheel rotary shafts 150, through which the toy car body 10 can be driven by children.

The first and second bonnet torsion springs 170 are mounted on the first and second bonnet rotary shafts 160 to provide given elastic force to the first bonnet part 120 and the second bonnet part 130, so that if the first bonnet part 120 and the second bonnet part 130 are released from their locking state, they can be rotated and open in the radial direction of the upper body part 110.

The lower housing 200 is mounted on the underside of the upper housing 100 and largely includes a lower body part 210, a support plate 220, a support plate torsion spring 240, the operating bar 250, an adhesion part 260 and an operating bar torsion spring 280. In this case, if the card 20 is attached to the toy car body 10, the operating bar 250 performs a locking releasing operation to allow the support plate 220 rotatably coupled to the underside of the lower body part 210 to be separated from the lower body part 210 and thus to pressurize a floor surface, so that the toy car body 10 while driving or stopping stands up or turns over.

The lower body part 210 includes an accommodating recess into which the support plate 220 is housed, a lower body hinge 211, an upper torsion spring insertion recess 214 formed on one side thereof and an operating bar hinge 212 and a lower body through-hole 213 formed on the other side thereof.

The lower body hinge 211 is formed on the front end of one side of the lower body part 210 in such a manner as to be coupled rotatably to the support plate 220 around the support plate rotary shaft 230 inserted into a through-hole 211', and the support plate torsion spring 240 is mounted on the lower body hinge 211.

The operating bar hinge 212 is mounted on the other side of the lower body part 210 to allow the operating bar 250 to be supported on the lower body part 210 in such a manner as to be rotated around the operating bar rotary shaft 270.

The lower body through-hole 213 is formed to a given size on the other side of the lower body part 210, through which the adhesion part 260 is passed and attached to the card 20.

The upper torsion spring insertion recess 214 is formed on the top surface of the accommodating recess into which the support plate 220 is housed and adapted to fixedly insert one side of the support plate torsion spring 240 thereinto in such a manner as to allow the support plate torsion spring 240 mounted on the support plate rotary shaft 230 to be elastically supported.

The support plate 220 is formed of a plate-like member mounted on the bottom surface of the lower body part 210 and has a support plate hinge 221 formed on the front end portion of one side thereof in such a manner as to be rotatably connected to the lower body hinge 211 of the lower body part 210 by means of the support plate hinge shaft 230, so that if the support plate 220 pressurizes the floor surface 30 by means of the elastic force of the support torsion spring 240, the toy car body 10 lifts up from the front surface thereof and finally stands up, or the toy car body 10 totally turns over.

Further, the support plate 220 has a lower torsion spring insertion groove 222 adapted to fixedly insert the other side of the support plate torsion spring 240 thereinto in such a manner as to allow the support plate torsion spring 240 mounted on the support plate rotary shaft 230 to be elastically supported.

Further, the support plate 220 has a support plate locking groove 223 formed on the front end of the other side thereof in such a manner as to be engaged with a support plate latch 253 of the operating bar 250, thereby allowing the locking state through the operating bar 250 to be maintained.

The operating bar 250 is coupled rotatably to the operating bar hinge 212 of the lower body part 210 around the operating bar rotary shaft 270, and if the card 20 is attached, the operating bar 250 is rotated to allow the support plate 220 and the first and second bonnet parts 120 and 130 of the upper housing 100 to be released from their locking state. The operating bar 250 includes an operating bar body 251, an adhesion part accommodating groove 252, the support plate latch 253, the first and second bonnet latches 254, and an operating bar lever 255.

The operating bar body 251 takes a shape of a bar having one side slantly formed around an arbitrary through-hole, and the through-hole is formed in such a manner as to be rotatable forwardly and reversely within a given range like a seesaw around the operating bar hinge 212 of the lower body part 210 and the operating bar rotary shaft 270.

The adhesion part accommodating groove 252 is formed on one side of the operating bar body 251 to mount the adhesion part 260 thereinto, and the adhesion part 260 is formed of any one of a magnet, an absorption plate, and an adhesive having viscosity. Desirably, the adhesion part 260 is formed of a magnet, and more desirably, it is formed of a neodymium magnet.

The support plate latch 253 is mounted on the other side of the operating bar body 251 in such a manner as to be engaged with the support plate locking groove 223 of the support plate 220 and has a given protrusion formed on the front end thereof in such a manner as to maintain the engaged state with the support plate locking groove 223 in the locking state.

The first and second bonnet latches 254 are a pair of fixing members extended by a given length from the top portion of the adhesion part accommodating groove 252 and has a given protrusion formed on the front end portions thereof in such a manner as to be engaged with the first and second bonnet locking portions 121 and 131 of the first and second bonnet parts 120 and 130.

That is, the first and second bonnet latches 254 are passed through the first and second through-holes 114 of the inner body 113 and engaged with the first and second bonnet parts 120 and 130 in such a manner as to maintain the locking state of the first and second bonnet parts 120 and 130.

The operating bar lever 255 is extended downward by a given length from the other side of the operating bar body 251, and if the card 20 is inserted beneath the toy car body 10, the operating bar lever 255 is brought into contact with the card 20 or the top surface of the card 20 and partially rotated upward around the operating bar rotary shaft 270, so that the adhesion part 260 is moved downward to make the card 20 easily attached thereto.

The operating bar torsion spring 280 is fitted to the operating bar rotary shaft 270 to which the operating bar hinge 212 of the lower body part 210 and the operating bar 250 are coupled, thereby providing a given elastic force with which the locking state of the operating bar 250 is maintained.

Figure 8:
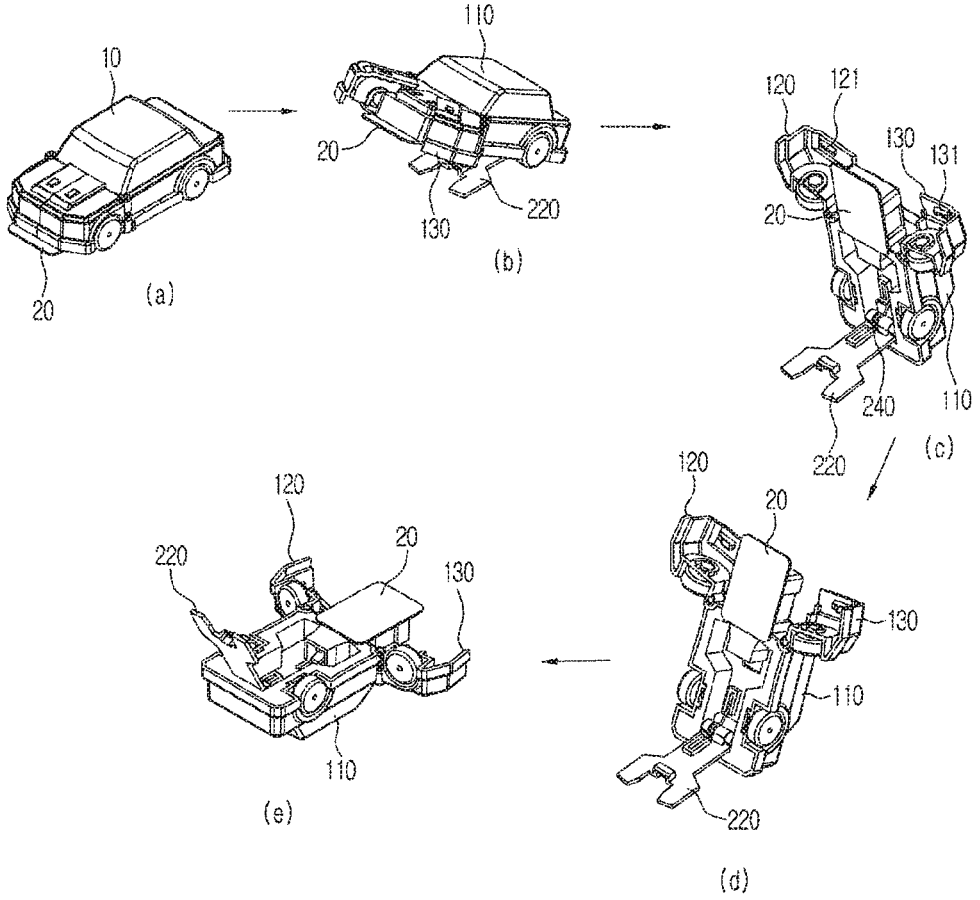
FIG. 8 shows perspective views of stages of transformation (a) through (e) showing the operating processes of the transformer toy car according to the present invention.

FIG. 8 shows perspective views of stages of transformation (a) through (e) showing the operating processes of the transformer toy car according to the present invention, and the operating processes of the transformer toy car according to the present invention will be explained with reference to FIG. 3 and stages (a) through (e) of FIG. 8.

If the toy car body 10 is passed through the top surface of the card 10 in the process of being driven, as shown in stage (a) of FIG. 8, the adhesion part 260 mounted on the lower portion of the toy car body 10 is attached to the card 20.

At this time, the adhesion part 260 is formed of a magnet, and the card 20 has a magnetic material or metal plate embedded thereinto, so that they are attached to each other by means of the attractive force caused by their magnetic field. Accordingly, the locking state formed by the operating bar 250, which is supported by means of the elastic force of the operating bar torsion spring 280, becomes released.

So as to allow the card 20 and the adhesion part 260 to be attached more easily to each other, further, if the operating bar lever 255 is located on the top surface of the card 20, one side of the operating bar 250 is moved upward by means of the operating bar lever 255, so that the other side of the operating bar 250 at which the adhesion part 260 is mounted is moved downward to make the adhesion part 260 easily attached to the card 20.

If the locking state formed by the operating bar 250 through the attachment of the adhesion part 260 to the card 20 is released, the first and second bonnet latches 254 mounted on the operating bar 250 are moved downward as the adhesion part 260 is moved downward, thereby allowing the engaged state with the first and second bonnet locking portions 121 and 131 to be released, so that the first bonnet part 120 and the second bonnet part 130 are released from their locking state and separatedly open to both sides of the toy car body 10, as shown in stages (b) and (c) of FIG. 8.

If the card 20 and the adhesion part 260 are attached to each other, further, the support plate latch 253 mounted on the operating bar 250 is moved upward by means of the operating bar lever 255, thereby allowing the engaged state with the support plate locking groove 223 to be released, so that the support plate 220 is released from the locking state and separated from the underside of the toy car body 10 to pressurize the floor surface, as shown in stages (b) and (c) of FIG. 8.

So as to allow the support plate 220 to pressurize the floor surface, at this time, the support plate torsion spring 240 continuously provides the elastic force to the support plate 220, and if the support plate 220 is rotated by about 90 degrees, as shown in stage (d) of FIG. 8, the toy car body 10 stands up. On the other hand, if the support plate 220 is rotated by about 90 degrees or more, as shown in stage (e) of FIG. 8, the toy car body 10 completely turns over.

In the state where the toy car body 10 stands up, only a user who is in front of the toy car body 10 can check the information on the card 20, and in the state where the toy car body 10 turns over, all of users can check the information on the card 20.

The standing or overturning state of the toy car body 10 is formed by providing a given elastic force to the support plate torsion spring 240. So to allow the standing state of the toy car body 10 to be maintained, further, a separate support part (not shown) may be provided on the lower end of the upper body part 110 of the toy car body 10, and alternatively, a given angle (for example, 90 degrees) is set to prevent the support plate 220 from being rotated by the given angle or more.

If the card 20 is removed from the standing toy car body 10 or the overturning toy car body 10, the magnetic field generated on the adhesion part 260 disappears, and the operating bar 250 returns to its original position by means of the elastic force of the support plate torsion spring 240.

As the operating bar 250 returns to its original position, the support plate latch 253 and the first and second bonnet latches 254 return to their original position. At this time, the support plate 220 returns to its original position to permit the support plate latch 253 and the support plate locking groove 223 to be engaged with each other, and further, the first and second bonnet parts 120 and 130 return to their original position to permit the first and second bonnet latches 254 and the first and second bonnet locking portions 121 and 131 to return to the locking state as their original position.

If the card is attached to the transformer toy car, accordingly, the transformer toy car automatically transforms the shape and turns over the card to provide the information on the card, thereby increasing the fun according to the card playing and causing the excitement of children.

Figure 9:
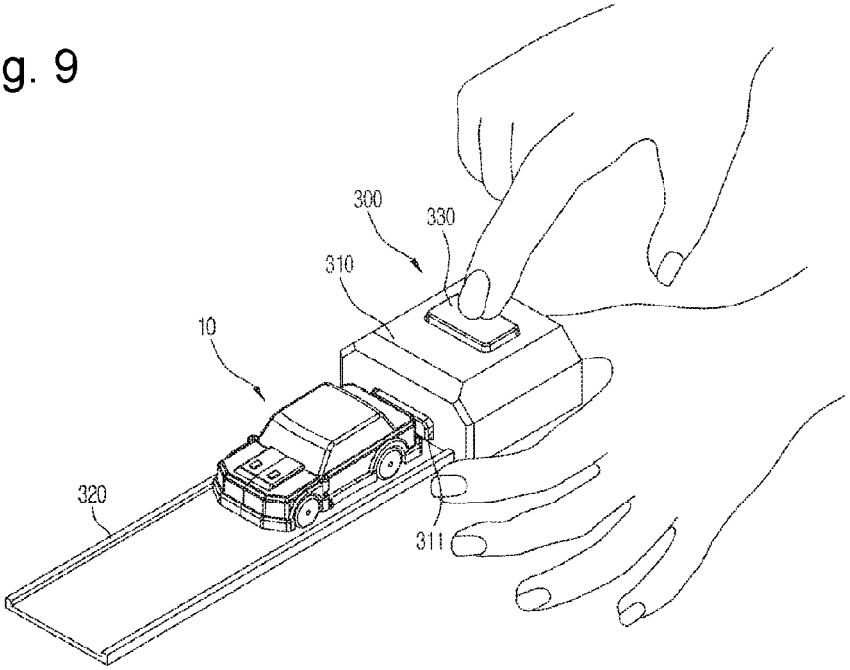
FIG. 9 is a perspective view showing a playing device using a transformer toy car according to the present invention.
Figure 10:
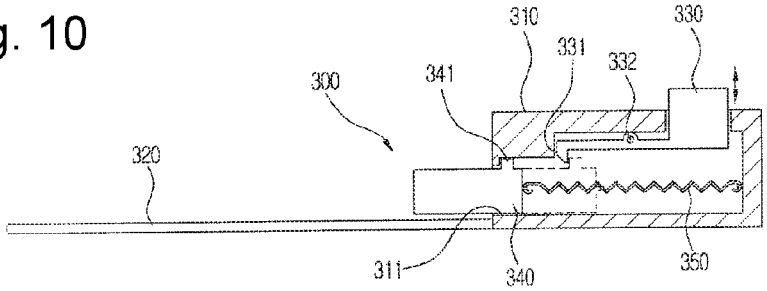
FIG. 10 is a sectional view showing the structure of a launch pad of the playing device using a transformer toy car according to the present invention.
Figure 11:
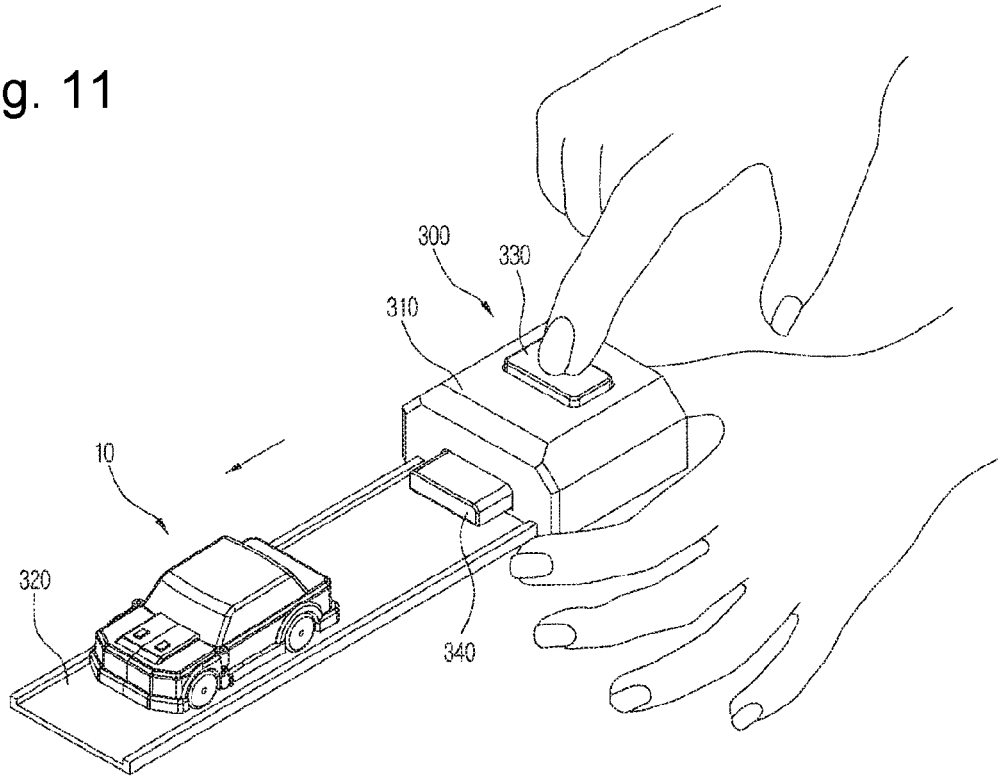
FIG. 11 is a perspective view showing the operating state of the playing device using a transformer toy car according to the present invention.

FIG. 9 is a perspective view showing a playing device using a transformer toy car according to the present invention, FIG. 10 is a sectional view showing the structure of a launch pad of the playing device using a transformer toy car according to the present invention, and FIG. 11 is a perspective view showing the operating state of the playing device using a transformer toy car according to the present invention.

As shown in FIGS. 9 to 11, a playing device using a transformer toy car according to the present invention includes a toy car body 10, cards 20, and a launch pad 300.

If the toy car body 10 is attached to one card 20 on the underside thereof, a portion of the separable toy car body 10 is separated, and a portion of the separated toy car body 10 pressurizes a floor surface, thereby making the toy car body 10 stand up or turn over and thus allowing the underside surface of the card 20 attached to the underside of the toy car body 10 to be exposed to the outside.

Each card 20, which is formed of a generally square-shaped member, has a coating layer formed on the surface where a given character or game information is printed and a magnetic material or metal plate member embedded thereinto.

The launch pad 300 serves to pressurize the toy car body 10 so that the toy car body 10 is driven in an arbitrary direction and includes a launch pad body 310, a rail 320, a button 330, a pressurizing part 340, and a coil spring 350.

The launch pad body 310, which is formed of a generally square-shaped member, has a hollow interior, into which the button 330, the pressurizing part 340, and the coil spring 350 are housed, and a through-hole 311 penetrating thereon, through which portions of the button 330 and the pressurizing part 340 are passed.

The rail 320 is extended by a given length from one side of the launch pad body 310 to guide the passage through which the toy car body 10 is driven in an arbitrary direction. The rail 320 has a groove portion 321 formed thereon to temporarily fix the toy car body 10 to an arbitrary position on the rail 320.

The groove portion 321 into which the rear wheels of the toy car body 10 are located to allow the toy car body 10 to be fixed to the rail 320.

The button 330 is mounted on the top portion of the launch pad body 310 in such a manner as to release the locking state of the pressurizing part 340 moved to compress the coil spring 350 and includes a button latch 331 and a button rotary shaft 332.

The button latch 331 is engaged with the pressurizing part 340 to fix the pressurizing part 340 to an arbitrary position.

The button rotary shaft 332 serves to allow the button 330 to be rotatably supported inside the launch pad body 310, and if the button 330 is pressed by a user, the button rotary shaft 332 allows the button latch 331 to be moved upward.

The pressurizing part 340 is mounted at the interior of the launch pad body 310 in such a manner as to be moved horizontally and serves to pressurize the toy car body 10 by means of the elastic force of the coil spring 350. The pressurizing part 340 has a pressurizing part latch 341 formed on the top portion thereof.

The pressurizing part latch 341 is engaged with the button latch 331 to allow the pressurizing part 340 to maintain the compression state of the coil spring 350.

The coil spring 350 is mounted at the interior of the launch pad body 310 to apply the elastic force for pressurizing the toy car body 10 to the pressurizing part 340.

Next, an explanation on the operating processes of the playing device using the transformer toy car according to the present invention will be given.

If the pressurizing part 340 protruded outward is pressurized and pushed into the launch pad body 310, it is moved by a given distance to permit the pressurizing part latch 341 and the button latch 331 to be engaged with each other, thereby causing the locking state, and the coil spring 350 becomes in a compressed state by means of the pressurizing part 340.

Next, the toy car body 10 is located on the rail 320 in such a manner as to place its rear wheels onto the groove 321, and the direction of the rail 320 is set to drive the toy car body 10 to the direction where the card 20 is placed.

If the setting is finished, the button 330 is pressed by the user to release the locking state between the button latch 331 and the pressurizing part latch 341.

If the locking state is released, the pressurizing part 340 pressurizes the toy car body 10 behind the toy car body 10 by means of the elastic force of the coil spring 350, thereby allowing the toy car body 10 to be driven in the set direction. While the toy car body 10 is being driven, if the card 20 is attached to the underside of the toy car body 10, a portion of the separable toy car body 10 is separated, and a portion of the separated toy car body 10 pressurizes a floor surface, thereby making the toy car body 10 stand up or turn over and thus allowing the underside surface of the card 20 attached to the underside of the toy car body 10 to be exposed to the outside.

As described above, the transformer toy car and the playing device using the transformer toy car according to the present invention automatically transform the shape and turns the card over to provide the information on the card, if the card is attached to the transformer toy car in the process where the transformer toy car is driven, thereby increasing the fun according to the card playing and causing the excitement of children.

Further, the transformer toy car and the playing device using the transformer toy car according to the present invention provide the power with which the transformer toy car is driven, thereby providing the playing games to a variety of ways and increasing the degrees of fun and toy car utilization.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A transformation toy car, comprising:

a toy car body; and an attachment member adapted to be attached to the toy car body, wherein the toy car body comprises:

a body part having at least one constituent part rotatably coupled to the body part by elastic force;

an operating bar supporting the at least one rotatably coupled constituent part such that the at least one rotatably coupled constituent part is fixed at a predetermined position of the body part; and an adhesion part configured to attach the attachment member to the body part of the toy car body, wherein, if the operating bar is in contact with the attachment member and the attachment member is attached to the adhesion part, the operating bar is displaced through the contact, the at least one constituent part fixed by the operating bar is separated from the body part and is configured to rotate such that at least one operation of transformation is carried out in a state in which the attachment member is attached to the adhesion part, and the toy car body is transformed.

2. The transformation toy car according to claim 1, wherein the attachment member comprises at least one of a magnetic material or a metal member embedded thereinto.

3. The transformation toy car according to claim 2, wherein the attachment member and the adhesion part are adhered to each other by attraction due to magnetic fields.

4. The transformation toy car according to claim 2, wherein:

the attachment member is in the shape of a card; and at least one of a certain character or game information is printed on a surface of the attachment member.

5. The transformation toy car according to claim 1, wherein the operating bar comprises an operating bar lever extended a predetermined length from one side of the operating bar so as to come into contact with the attachment member.

6. The transformation toy car according to claim 1, wherein the transformation is at least one of a standing-up of the toy car body or a rotation of the toy car body.

* * * * *